US005279220A

United States Patent [19]

Clifton et al.

[11] Patent Number: 5,279,220

[45] Date of Patent: Jan. 18, 1994

[54] SCREEN PRINTING APPARATUS

[76] Inventors: Cynthia S. Clifton, 2118 Alameda Ave., Sarasota, Fla. 34234; Roger F. Wilson, 1923 Wood Hollow La., Sarasota, Fla. 34235

[21] Appl. No.: 26,295

[22] Filed: Mar. 4, 1993

[51] Int. Cl.[5] ..... B05C 17/06

[52] U.S. Cl. ..... 101/126; 101/84

[58] Field of Search ..... 101/115, 126, 127.1, 101/DIG. 36, 123, 72, 78, 84; 33/614, 620; 400/171, 172

[56] References Cited

U.S. PATENT DOCUMENTS

| | | | |
|---|---|---|---|
| 2,206,176 | 7/1940 | Foard | 101/126 |
| 3,183,005 | 5/1965 | Rockola . | |
| 3,662,344 | 5/1972 | Menke | 340/162 |
| 3,690,680 | 9/1972 | Lumney et al. | 274/10 D |
| 4,195,567 | 4/1980 | Mitter | 101/115 |
| 4,381,706 | 5/1983 | Harpold | 101/127.1 |
| 4,606,268 | 8/1986 | Jaffa | 101/115 |
| 4,708,057 | 11/1987 | Hogenson | 101/129 |
| 4,809,604 | 3/1989 | Harpold | 101/115 |
| 5,094,160 | 3/1992 | Jennings | 101/127.1 |
| 5,107,760 | 4/1992 | Pratt | 101/115 |
| 5,161,460 | 11/1992 | Andersen et al. | 101/127.1 |

*Primary Examiner*—Edgar S. Burr
*Assistant Examiner*—Ren Yan
*Attorney, Agent, or Firm*—Armstrong, Westerman, Hattori, McLeland & Naughton

[57] ABSTRACT

An apparatus for silk screening numbers onto uniforms, the apparatus comprises a base, support means on the base for mounting a plurality of numbered silk screens, one silk screen after the other, with the silk screens in axial alignment with each other and with the axis of the support and with the screens transverse the axis. Each silk screen is mounted on the support so as to be rotatable from a first position transverse the support axis to a second position in parallel alignment with the support axis and in alignment with a platen horizontally disposed on the base in parallel alignment with the screen support. The platen has a surface for supporting a uniform member to be silk screen numbered and the support, with the silk screens mounted thereon and the platen are axially movable relative to each other. The platen includes alignment means for aligning a selected one of the silk screens bearing a number to be silk screened on the uniform member, with the uniform member on the platen, as such silk screen is rotated into printing contact with such uniform member.

5 Claims, 8 Drawing Sheets

SCREEN PRINTING APPARATUS

FIELD OF THE INVENTION

This invention relates to an apparatus for use in silk screen printing and, more particularly, to an apparatus for use in silk screen printing of numbers, and the like, on uniforms, such as athletic uniforms or other uniforms where numbers, or other indicia, on the back or front, or both the bank and front, is used to identify one player, or individual, from other players or individuals otherwise wearing the same uniform or clothing.

BACKGROUND OF THE INVENTION

In football, baseball, basketball, track, and other sports, where the members of each of the participating teams wear identical uniforms and, thus, are not readily distinguishable, one player from the other, it has been common practice, for some time, to identify such players, one from the other, by assigning a different number to each player and placing such number on the back or front, or both the back and front, of the shirt, jersey, blouse or upper part of the players' uniform to be worn by the player and, often, jackets, robes and other accessories worn with the uniform. Such numbers have usually been sewn on such shirt, jersey, blouse or upper uniform part and such jackets, robes and accessories. Thus, such numbers are cut from cloth, positioned at the intended place on the shirt, jersey, blouse, etc., and sewn in place. Such cloth, and the cutting, positioning and sewing thereof on the shift, jersey, blouse, etc., adds to the cost of the uniform. To reduce such costs, such numbers, or other identifying indicia, are silk screen printed directly onto the cloth of the uniform shirt, jersey, blouse, and other accessories.

Because the number of team players on teams engaged in most sports are in excess of nine and, more commonly, less than one hundred, a numbering system, with numbers from zero and ninety-nine is most commonly employed. Providing a silk screen for each number, from zero to ninety-nine, add to the cost of silk screening. On the other hand, however, using silk screens for the individual numbers, zero to nine, and selecting, combining and aligning the selected numbers to provide the desired number and silk screening such selected numbers on the shirt, jersey, blouse, etc., to which the numbers are to be applied, requires considerable handling of such silk screens, alignment of the individual numbers and adds to costs of silk screening.

In the instant invention, many of the problems and costs heretofore encountered in the silk screening of numbers, or other indicia, on shirts, jerseys, blouses, etc., on uniforms and accessories are eliminated and the costs and handling of such silk screens and the carrying out of such silk screening is reduced. This is accomplished in the present invention by providing an apparatus in which silk screens are pivotally aligned in order, one silk screen behind the other on a screen support with the planes of the silk screens perpendicular to the plane of the platen upon which the article to be silk screened with the selected number is placed. The platen, with the article to be silk screened with a number thereon and the screen support, with the silk screens aligned in order thereon, one after the other, are moved relative to each other to bring the silk screen of one of the numbers selected to be applied to the article in substantial alignment with the article at the point where the silk screening is to take place. The silk screen is then pivoted on the silk screen support toward the platen and the article to which the selected number is to be applied and, when clear of the adjacent silk screens, is then pivoted so to be substantially parallel to the platen and the article. The arm upon which the selected silk screen is supported is then brought into the engagement with a silk screen guide on the platen support and the silk screen is guided into engagement with the article at the position where the number on the selected silk screen is to be applied to the article. With the silk screen in contact with the article, the number is silk screened onto the article. The silk screen arm, with the silk screen thereon, is pivoted away from the article, the silk screen is pivoted on the silk screen support so as to again be substantially perpendicular to the platen and into alignment with the silk screens at the opposite sides thereof. The platen and the silk screen support are again moved relative to each other to bring the silk screen with the next number to be applied to the article into position and the silk screen pivoting, engagement with the alignment means at the second position, positioning of the silk screen on the article and silk screening is repeated. After the next number is silk screened on the article, the silk screen is returned to its original, or rest position, in-line with the other silk screens, the article is removed from the platen, the next article to be silk screened is positioned on the platen and the operation is repeated.

DESCRIPTION OF THE PREFERRED EMBODIMENTS

The instant invention will be more fully described and better understood from the following description taken with the attached drawings of preferred embodiments of the invention in which.

Figure 1:
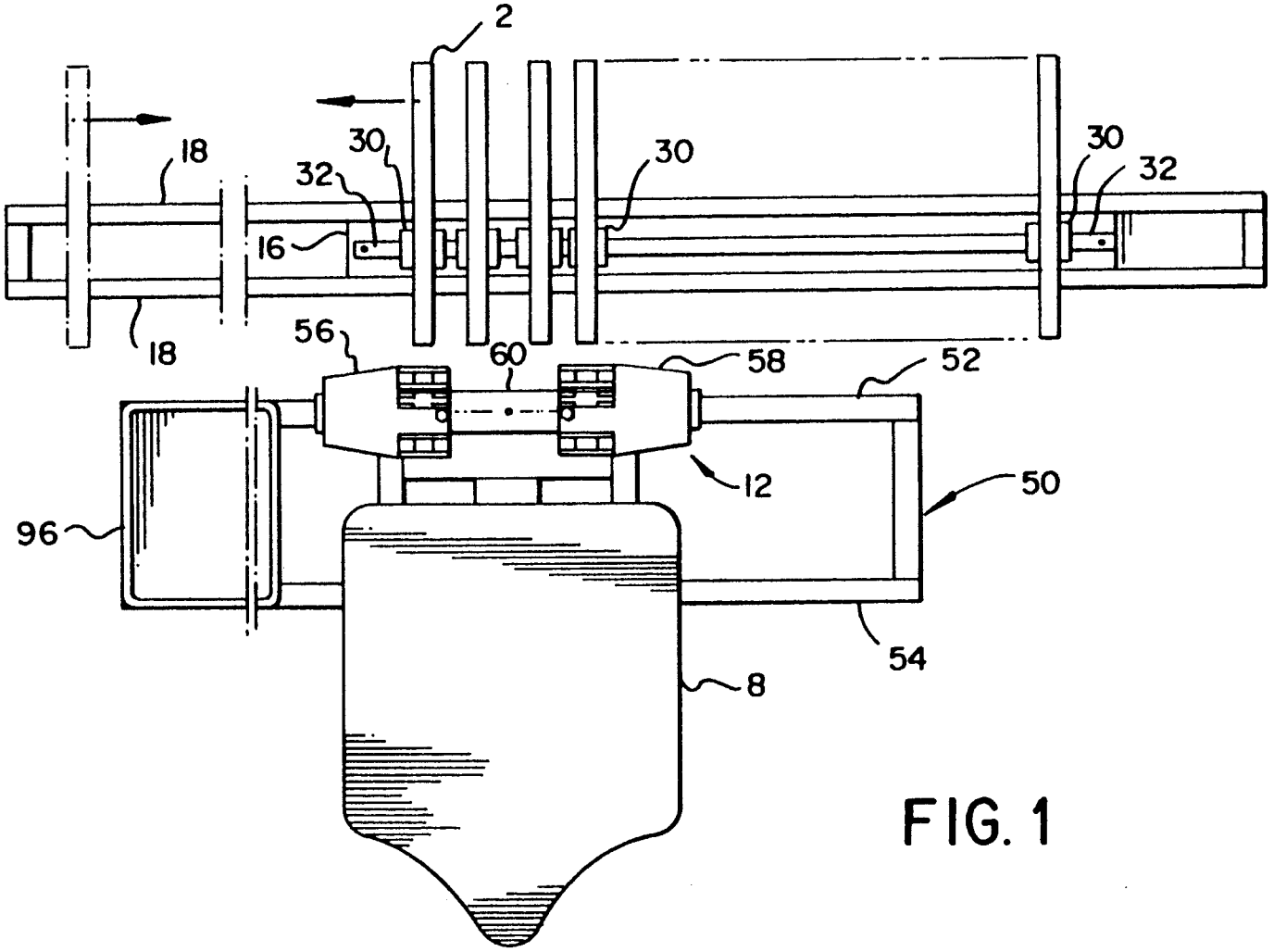
FIG. 1 is a top plan view of the apparatus of one embodiment of the invention.
Figure 2:
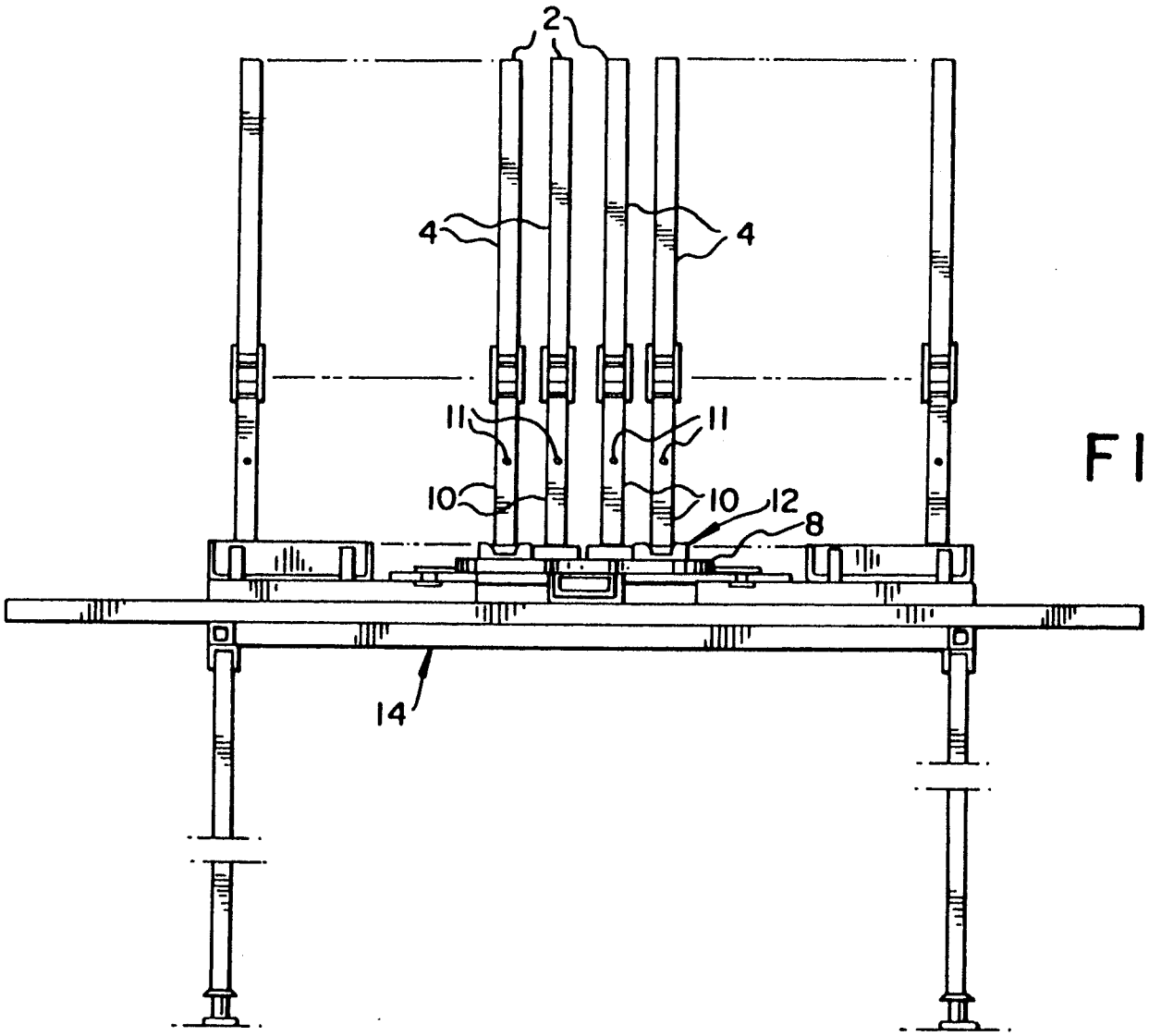
FIG. 2 is a side elevation view of the apparatus of FIG. 1.
Figure 3:
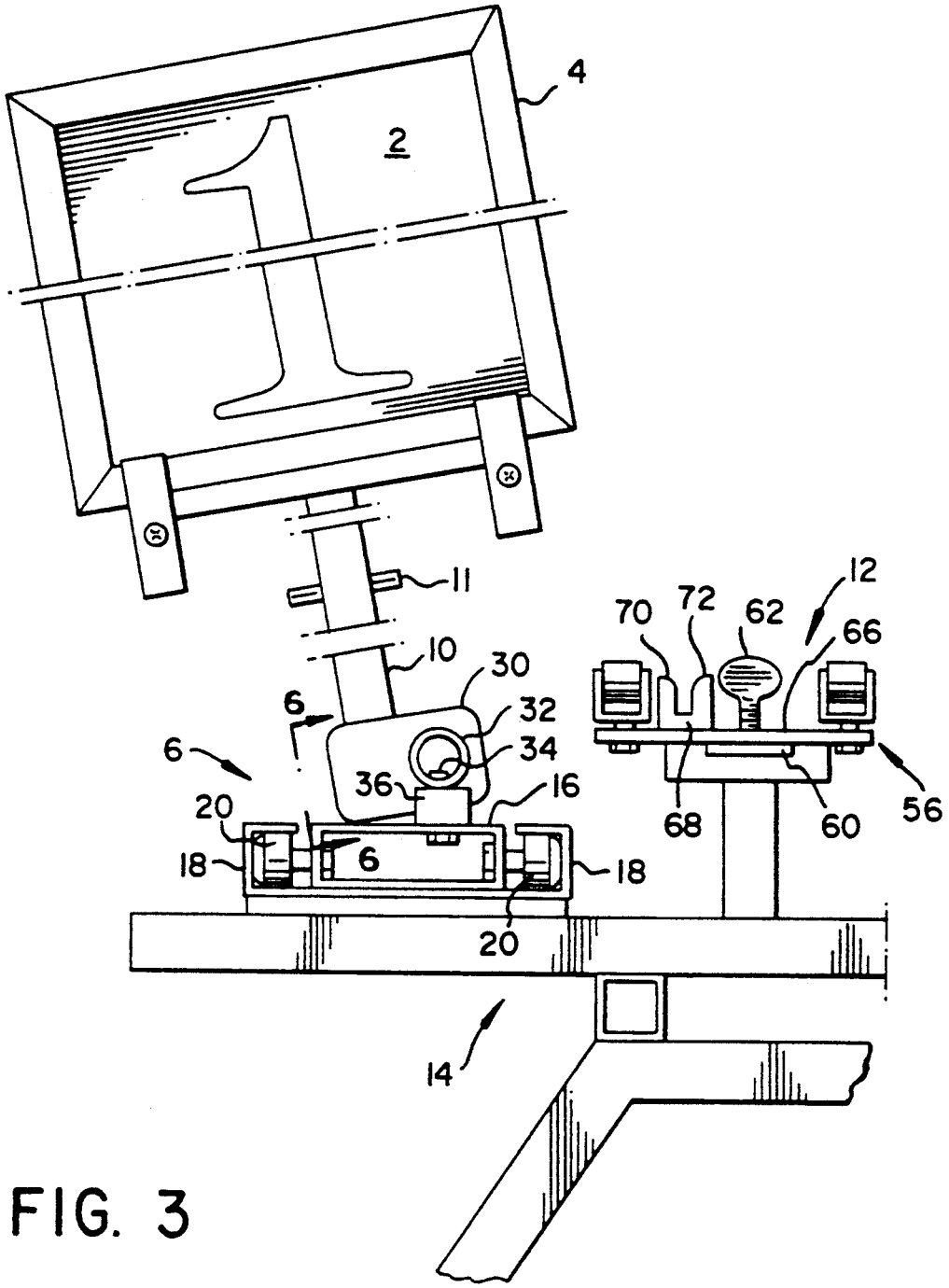
FIG. 3 is an enlarged partial end view, taken from the left, of the apparatus of FIGS. 1 and 2.

Referring to the drawings, the silk screening apparatus of the embodiment of FIG. 1 includes ten silk screens 2, each bearing a number zero to nine, respectively, and each mounted in a screen frame 4 on a screen arm 10, FIG. 3, in turn mounted on a silk screen support, generally designated 6, for axial alignment, by pin 11 on screen arms 10, FIGS. 2 and 3, and silk screen guide, generally designated 12, with platen 8, all supported on a base frame, generally designate 14, supporting the apparatus at a distance from the floor suitable for operation by an operator.

In the embodiment of FIGS. 1-3, platen 8 is in fixed position, and frames 4, each with a silk screen 2, are movable in an axial direction relative to platen 8. Thus, silk screen support 6 includes a screen trolley tube 16, FIGS. 1 and 3, mounted for movement in tracks 18, 18, on plastic wheels 20, fixed to opposite sides of trolley 16 for rotation relative to trolley tube 16, FIG. 3 at opposite ends of trolley 16, FIG. 1. Steel balls, not shown, may be provided at the outer ends of plastic wheels 20 for engaging the tracks 18 and enhancing the ease of movement of trolley 16 in tracks 18.

Figure 7:
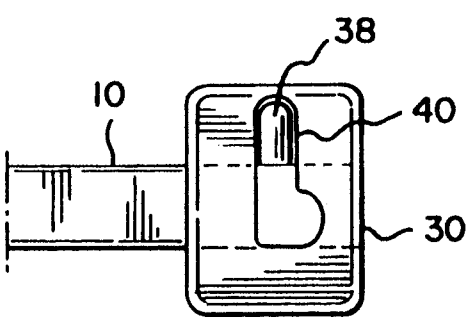
FIGS. 6 and 7 are enlarged views taken from 6—6, FIG. 3 showing the silk screen arm in different positions on the support.
Figure 12:
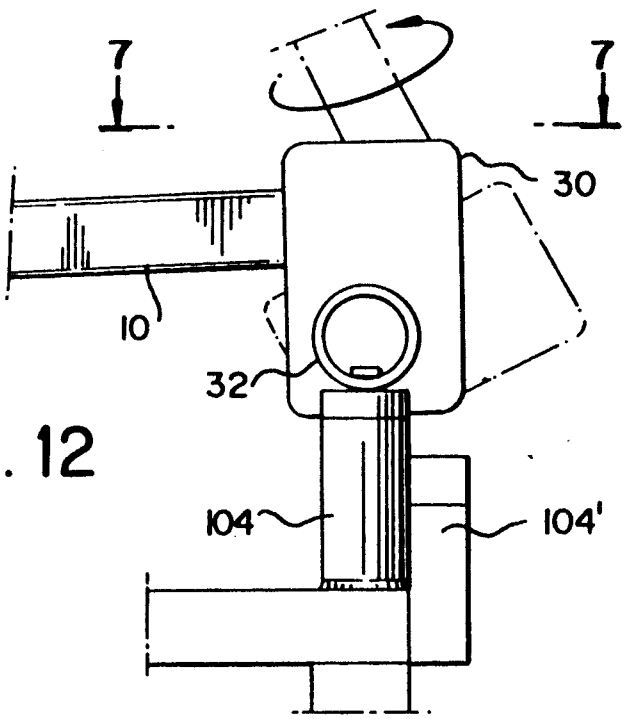
FIG. 12 is a view similar to FIG. 11 but showing the silk screen and the support in printing position.
Figure 6:
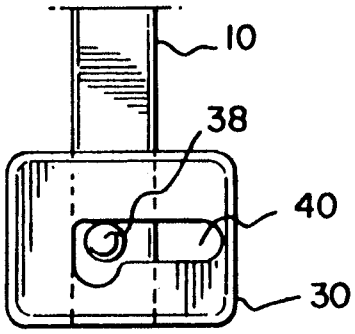
Figure 11:
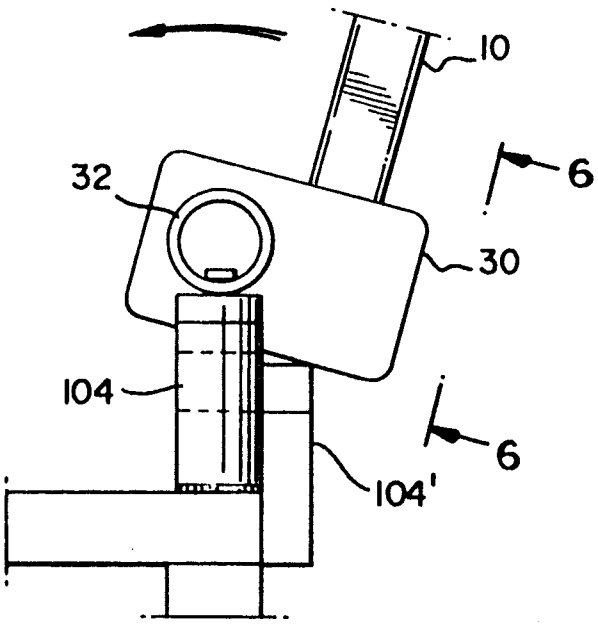
FIG. 11 is a further enlarged view of the silk screen arm and support of FIGS. 9, 10 and 11 but taken from the right hand end of FIGS. 9 and 10 and showing the silk screen arm in the storage position.
Figure 10:
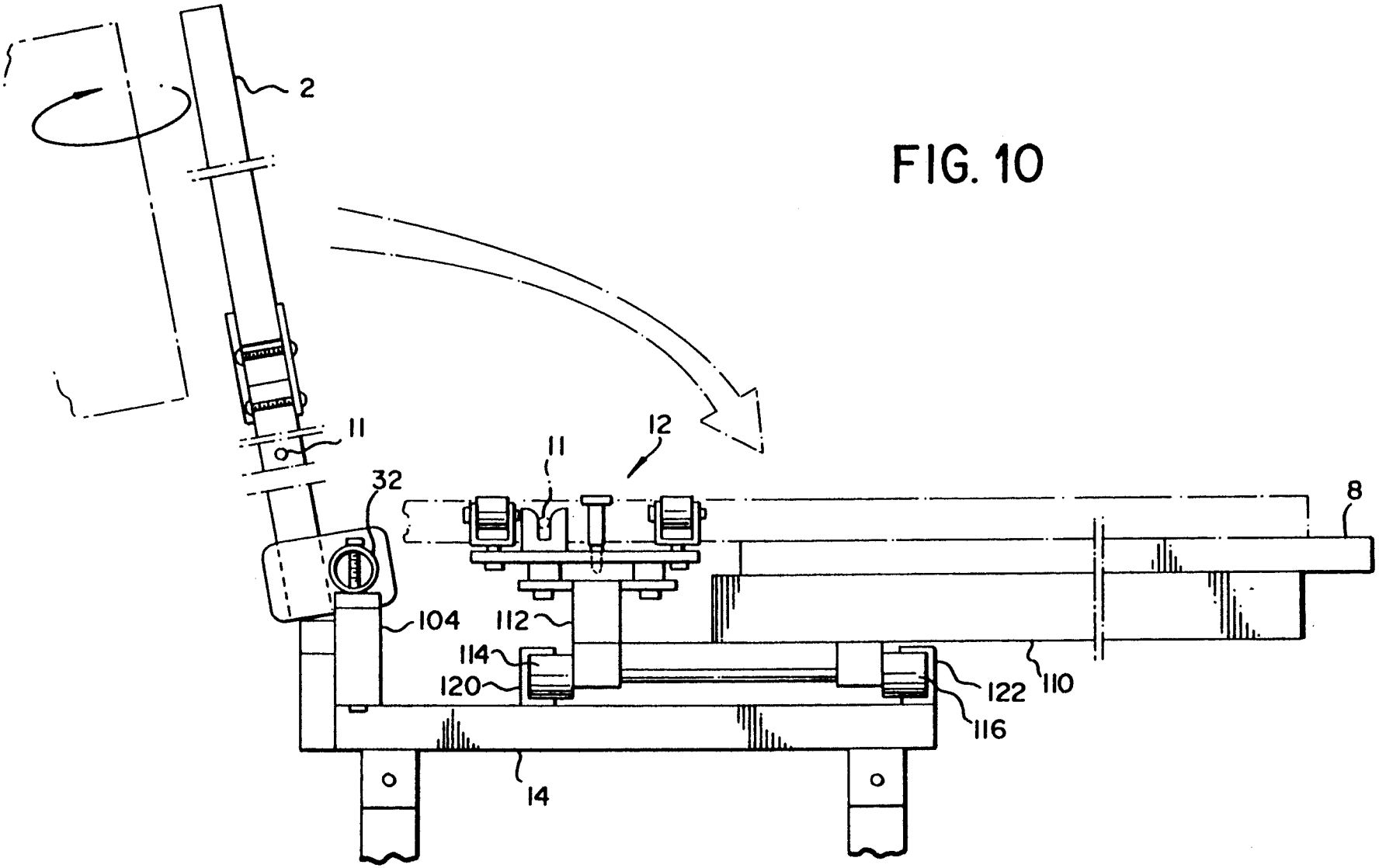
FIG. 10 is an enlarged end view of the apparatus of FIG. 8 taken from the left end of FIG. 8.

Screen arms 10 are each rotatably mounted in a screen arm block 30, FIGS. 1, 3, 11 and 12 rotatably mounted on screen arm block tube 32 fixed in FIG. 1 and 3 to screen trolley tube 16 by pin 34 and spaced therefrom by spacer 36 at the opposite ends of trolley tube 16 and on fixed spacer 104, FIGS. 10, 11 and 12. As bets shown in FIGS. 6 and 7, screen arm blocks 30 are hollow and in the wall receiving the screen arms 10 are provided with a keyway 40 for receiving a pin 38 adjacent the end of arm 10 in arm block 30, and allowing arm 10 to be rotated in the direction of the keyway, but not in other directions.

Silk screen guide 12, made up of horizontally adjustable guide members 56, 68, and platen 8 are fixed to support 50, mounted on frame 14, silk screen guide 12 being mounted on support member 52, intermediate screen trolley tube 16 and track 18 and platen 8 fixed to support member 54, FIG. 1.

Figure 4:
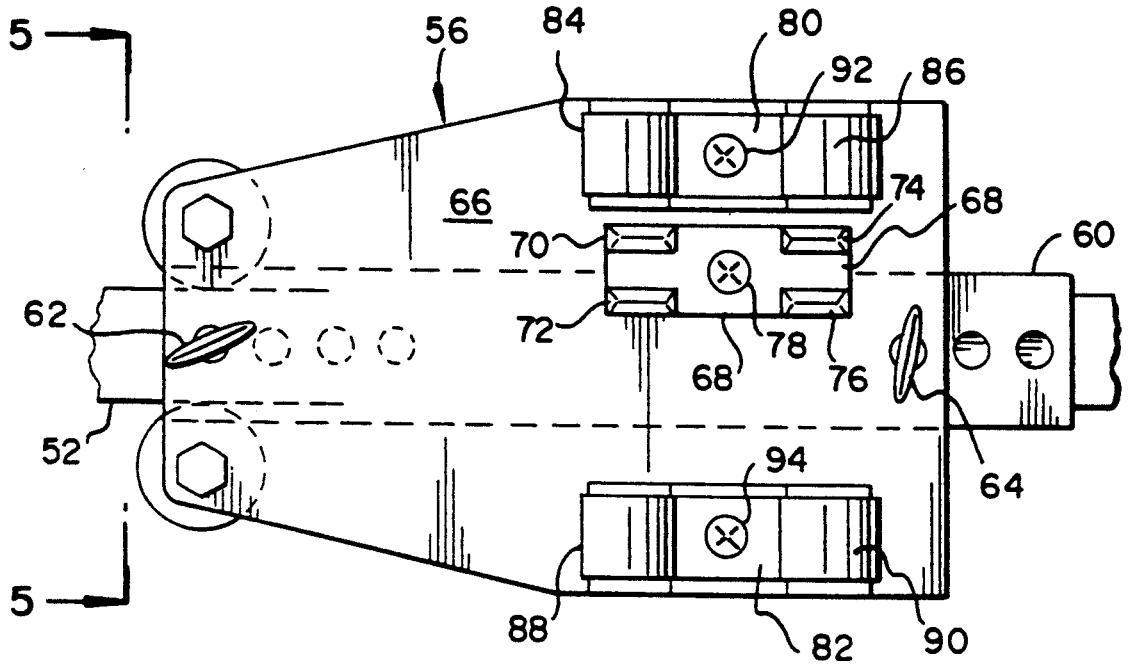
FIG. 4 is an enlarged top plan view of the silk screen guide means of FIG. 1.
Figure 5:
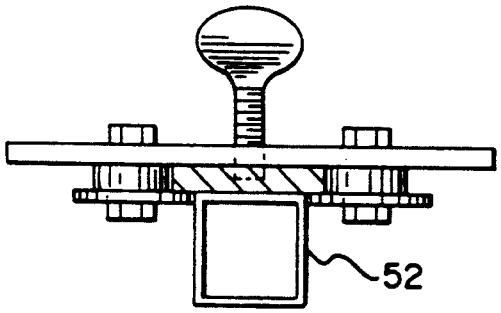
FIG. 5 is an end view taken at 5—5, FIG. 4.

Guide members 56, 68 are slidably mounted on register bar 60 for alignment of each of the silk screens 2 with the article on platen 8 on which the selected numbers are to be silk screened when such selected silk screen is in place and are individually adjustable toward and away from each other on register bar 60 by sliding the guide member being adjusted on guide bar 60 and locking the adjusted guide member in position by tightening adjustment screws 62, 64. Guide members 56, 68 are mirror images and, in the description which follows, only guide member 86, FIG. 4, will be described, such description, except for the mirror image, being identical.

Guide member 56 includes a base 66, adjustable on guide bar 60 and locked in adjusted position thereon by tightening adjustment screws 62, 64, pin guides 70, 72 and 74, 76 for receiving the ends of guide pins 11 on silkscreen arms 10 and fixed to base 66 by screw 78 and arm guides plastic rollers 84, 86 and 88, 90 rotatably mounted thereon for receiving silk screen arms 10 therebetween and are mounted in fixed position on base 66 by screws 92, 94. A silk screen ink pan 96, FIG. 1, for the ink to be used in the silk screen printing and for holding a silk screen squeegee, not shown, is mounted on support members 52, 54, at one side of the platen 8 and silk screen guide 12 or, as shown in FIG. 2, identical ink and squeegee pans may be mounted at opposite sides of silk screen guide 12.

Except for the mountings of the silk screens 2 and the platen 8 and silk screen guides 12, the embodiments of FIGS. 1-7 and 8-12 are identical. Where such embodiments differ is that, in the embodiment of FIGS. 1-7, the silk screen support 6 is movable, allowing the selected silk screen to be moved axially of the support and into alignment with screen guide 12 and platen 8, which are fixed to the frame while, in the embodiment of FIGS. 8-12 silk screen support 6 is fixed and screen guide 12, with platen 8, are movable.

Referring now to FIGS. 8-12, like elements are referenced with like reference numerals and are not further described, the description which follows, being directed to those elements which are different.

Figure 8:
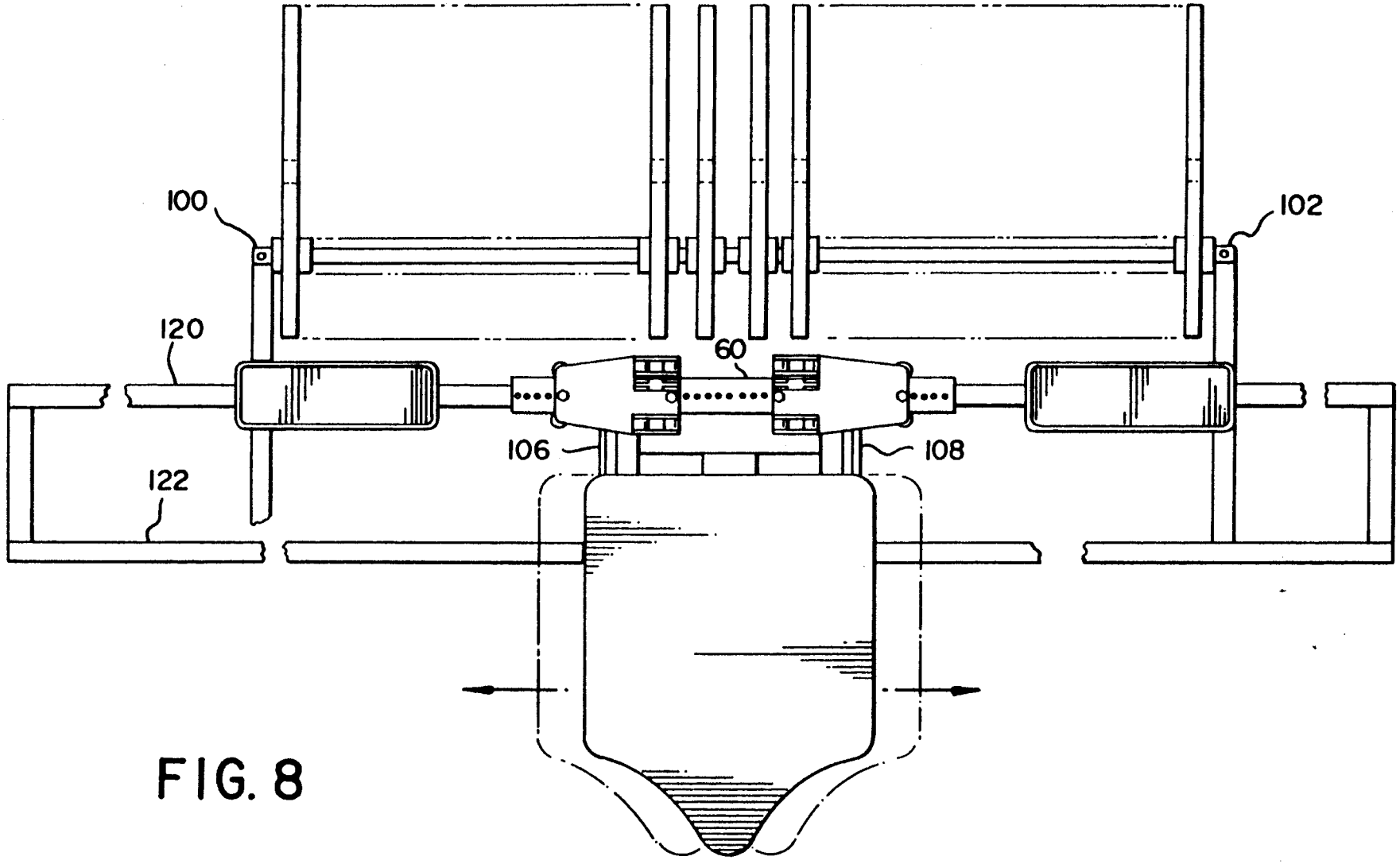
FIG. 8 is a top plan view, similar to FIG. 1 but showing a second embodiment of the invention.
Figure 9:
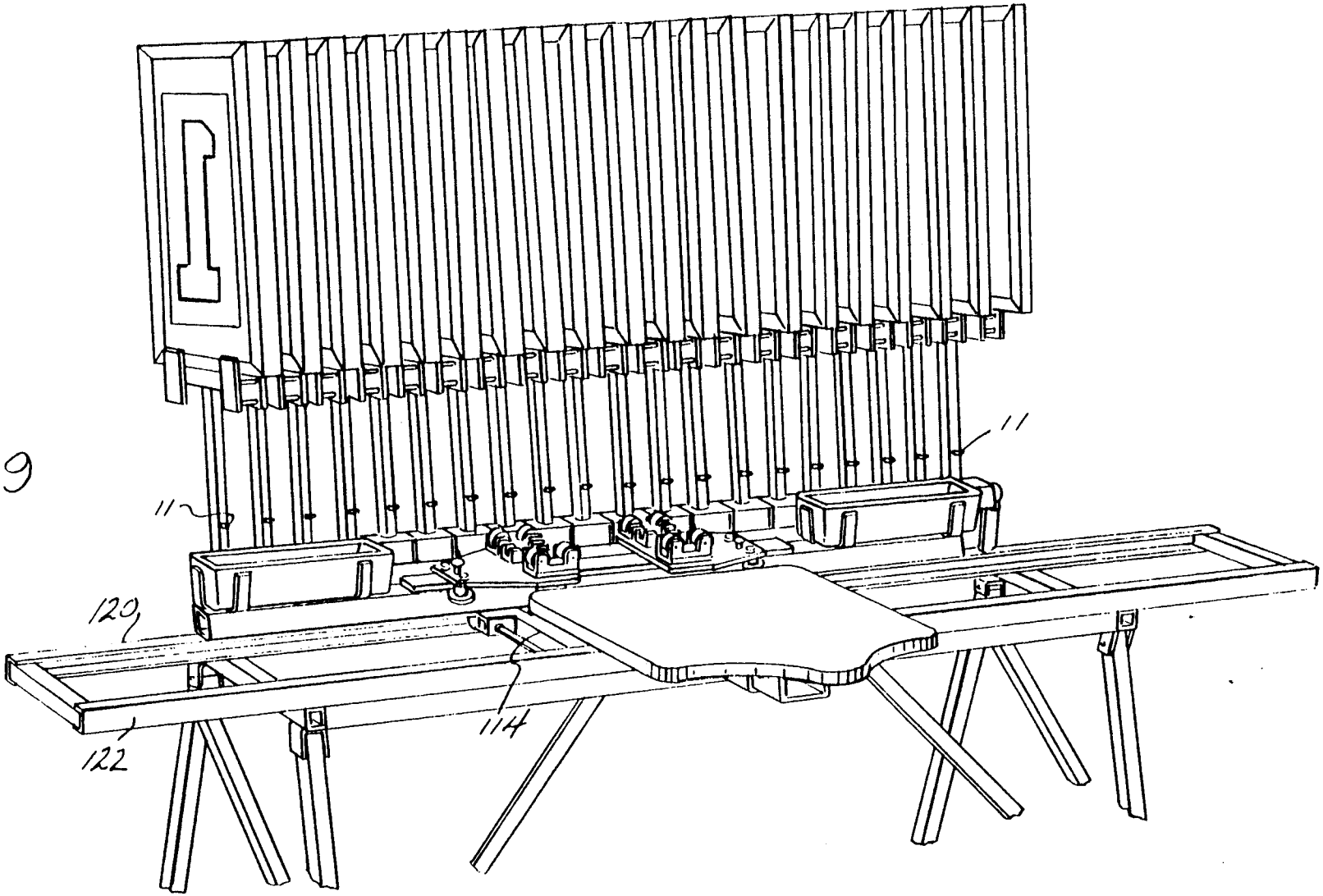
FIG. 9 is a perspective view of the apparatus of the embodiment of FIG. 8.

As best shown in FIGS. 8 and 10, the opposite ends of screen arm block tube 32, FIGS. 11 and 12, are fixed at 100, 102, spacers 104 with stops 104 are fixed to the frame 14. Thus, unlike the screens 2 in the embodiment of FIGS. 1-7, such silk screens 2 in the embodiment of FIGS. 8-10 are not axially movable. On the other hand where, in the embodiment of FIGS. 1-7, the silk screen guide 12 and platen 8 were fixed, in the embodiment of FIGS. 8- 10, such screen guide 12 and platen 8 are movable. Hence, screen guide 12 and platen 8 are fixed to each other by tie bars 106, 108, FIG. 8 and, at the opposite sides of platen 8 and opposite ends of screen guide 2 are supported by platen spacer 110 and screen guide spacer on plastic wheels 114, 116 of trolley 118 in tracks 120, 122. As best shown in FIGS. 8 and 9, tracks 120, 122 extend well beyond the ends of screen block tube 32. By moving trolley 118 along tracks 120, 122, screen guides 56, 58, as the case may be, can be aligned with the endmost screen 2, at the opposite ends of stationary screen block tube 32 to align such endmost screen with the screen guide so that the number thereon can be silk screened on the article on the platen. The embodiment of FIGS. 8-12 is particularly useful where, for example, different colors are to be silk screened and different screens are required for such different colors.

In the operation of the apparatus of the embodiments of the instant invention, the article to be silk screened, be it a shirt, jersey, blouse, etc., is aligned on the platen with the positions on the shirt, jersey, blouse, etc., in alignment with guide members 56, 58 and the silk screen, with the number to be applied to such article, is brought into approximate alignment with the guide member 56, 58 at the position of the article where such select number is to be applied. This is accomplished in the first embodiment of the invention, as shown in FIGS. 1-7, by moving the screens laterally with respect to the screen guide 12 and platen 8 until the screen 2, with the selected number is in substantial alignment with the screen guide 12 and platen 8, or, in the instance of the embodiment of the invention, as shown in FIGS. 8-12, by moving the screen guide 12 and platen 8 laterally in substantial alignment with such screen with the selected number.

When screen 2, with the selected number, and screen guide 12 and platen 8 are in substantial alignment, irrespective of which embodiment of the invention is employed, such screen 2, with the selected number, is pivoted on screen arm block tube 32 toward screen guide 12 and platen 8 until selected screen 2 is clear of adjacent screens 2 and selected screen 2 is pivoted in its arm block 30 into substantial parallel alignment with platen 8. As pivoting of selected screen 2 on screen arm block tube 32 continues, silk screen arm 10 first comes into contact with plastic guide rollers 84, 86, spring arm guide pin 11 comes into contact with pin guides 70, 72 and 74, 76, screen arm 10 comes into contact with plastid guide rollers 88, 90 and the screen is brought into aligned position with the article to which silk screening of the number is to be accomplished. The squeegee, with the silk screening ink thereon, is removed from pan 96, the ink is applied to the silk screen to print the selected number on the article, the squeegee is returned to pan 96 and screen arm 10, with screen 2 thereon is pivoted, in reverse, rotated and returned to its place with the other screens. The screen to the next number to be applied is selected and the operating sequence repeated, usually to the next of the two numbers to be silk screened to the same article, usually with the other arm guide so that the numbers are side-by-side on the article. With the number or numbers complete, the article is removed from the platen, the next article is aligned on the platen and the process is repeated.

To silk screen print the number "42," for example with "6" number silk screens, the plastic guide rollers to the left and right of the position on the article where the number is to be printed are set on a four inch center. The screen with the number "4" is selected, pivoted to about a 45 degree angle, registered to the point for the right-hand number, rotated so that the screen is horizontal and pivoted into the guide rollers and pin guides. The number "4" is then screen printed, the silk screen is pivoted, rotated and again pivoted back into its original place and the process is then repeated with the screen of the number "2" using the guide point for the left-hand number.

The apparatus is compact, adjustable to any size number from "2" to "12" in height, is fast and efficient.

While the instant invention has been shown and described with specific reference to embodiments presently contemplated as the best mode of carrying out the invention in actual practice, it is to be understood that various changes may be made in adapting the invention to different embodiments without departing from the broader inventive concepts disclosed herein and comprehend by the claim which follow.

What is claimed is:

1. An apparatus for silk screening individual identification numbers onto uniforms, said apparatus comprising a base, support means on said base for mounting a plurality of numbered silk screens, one silk screen of said plurality of silk screens after another of said silk screens, in a first position in which said silk screens are in axial alignment with each other and with the axis of said support means, each silk screen aligned with the other silk screens along said support means, with said silk screens transverse to said axis of said support means, means for selectively rotating each of said silk screens from said first position into a second position in which a selected one of said silk screens is out of axial alignment with said other silk screens and in parallel alignment with said support means, a horizontally disposed platen on said base in parallel alignment with said support means and having a surface for supporting a uniform member to be silk screen numbered, guide means adjustably fixes to said platen for guiding said selected one of said silk screens into silk screen printing alignment with said uniform member on said silk screen where the number on said selected one of said silk screens is to be printed on said uniform member and means for moving one of said support means and said platen parallel to the other of said support means and said platen for aligning said selected one of said silk screens for silk screening a number of said silk screen on said uniform member on said platen to be silk screen numbered.

2. An apparatus for silk screening, as recited in claim 1, in which at least two guide means are adjustably fixed to said platen for selectively guiding silk screens into silk screen printing alignment with said uniform member.

3. An apparatus for silk screen printing, as recited in claim 1, in which said silk screens are each mounted on a silk screen support arm pivotally and rotatably mounted on said support means, said screen support arm engaging said guide means for aligning said selected one of the silk screens with the platen.

4. An apparatus for silk screen printing, as recited in any one of claims 1, 2 or 3, in which said support means, with said silk screen mounted thereon, is movable parallel to said platen and said platen, with said guide means fixed thereto, is fixed.

5. An apparatus for silk screen printing, as recited in any one of claims 1, 2 or 3, in which said support means, with said silk screens mounted thereon, is fixed and said platen, with said guide means fixed thereto, is movable parallel to said support means, with said silk screens mounted thereon.

* * * * *